United States Patent [19]

Barlow

[11] Patent Number: 4,714,249

[45] Date of Patent: Dec. 22, 1987

[54] ANTEATER GAME

[75] Inventor: Gordon A. Barlow, Glenview, Ill.

[73] Assignee: Gordon Barlow Design, Skokie, Ill.

[21] Appl. No.: 46,778

[22] Filed: May 7, 1987

[51] Int. Cl.[4] ..... A63F 9/00

[52] U.S. Cl. ..... 273/1 G; 273/1 GG

[58] Field of Search ..... 273/1 G, 1 GC, 1 GG

[56] References Cited

U.S. PATENT DOCUMENTS

| | | | |
|---|---|---|---|
| 3,545,750 | 12/1970 | St Achnik, Sr. | 273/1 GG |
| 3,638,945 | 1/1972 | Breslow | 273/1 G X |
| 4,133,525 | 1/1979 | Balles et al. | 273/1 GC |
| 4,299,003 | 10/1980 | Shimizu | 273/1 GG X |

*Primary Examiner*—Paul E. Shapiro

*Attorney, Agent, or Firm*—Kinzer, Plyer, Dorn, McEachran & Jambor

[57] ABSTRACT

A game including an annular plastic housing having a central opening extending from the top to the bottom thereof. A rotatable disk is located in the central opening. An electric motor having a drive shaft to engage and rotate the disk is provided. A transparent cover is positioned on the annular plastic housing a small distance above the rotatable disk to provide a raceway between the disk and the cover. Walls depend from the transparent cover and terminate slightly above the rotatable disk. The walls are shaped to form pockets and flow paths as well as barricades for the pockets around the periphery of the transparent cover. A plurality of small, somewhat cylindrical plastic parts are placed on the disk to be moved through the raceway upon rotation of the disk. Each pocket has an inlet opening facing the direction of rotation of the disk and an outlet opening facing away from the direction of rotation of the disk. A gate to open and close the outlet opening of each pocket is installed. An arm swingable in an arc across a portion of the cover is installed at each pocket. Each arm has a guide portion normally biased to a position to block the entrance to its pocket. Each guide portion has a pair of fingers to receive one of the small, plastic cylindrical parts lengthwise and admit into the pocket when the guide is swung to the entrance to the pocket. The pockets are each designated by a distinctive color, and an equal number of the small, plastic cylindrical parts are identified with the color of a pocket.

8 Claims, 10 Drawing Figures

Fig. 5.
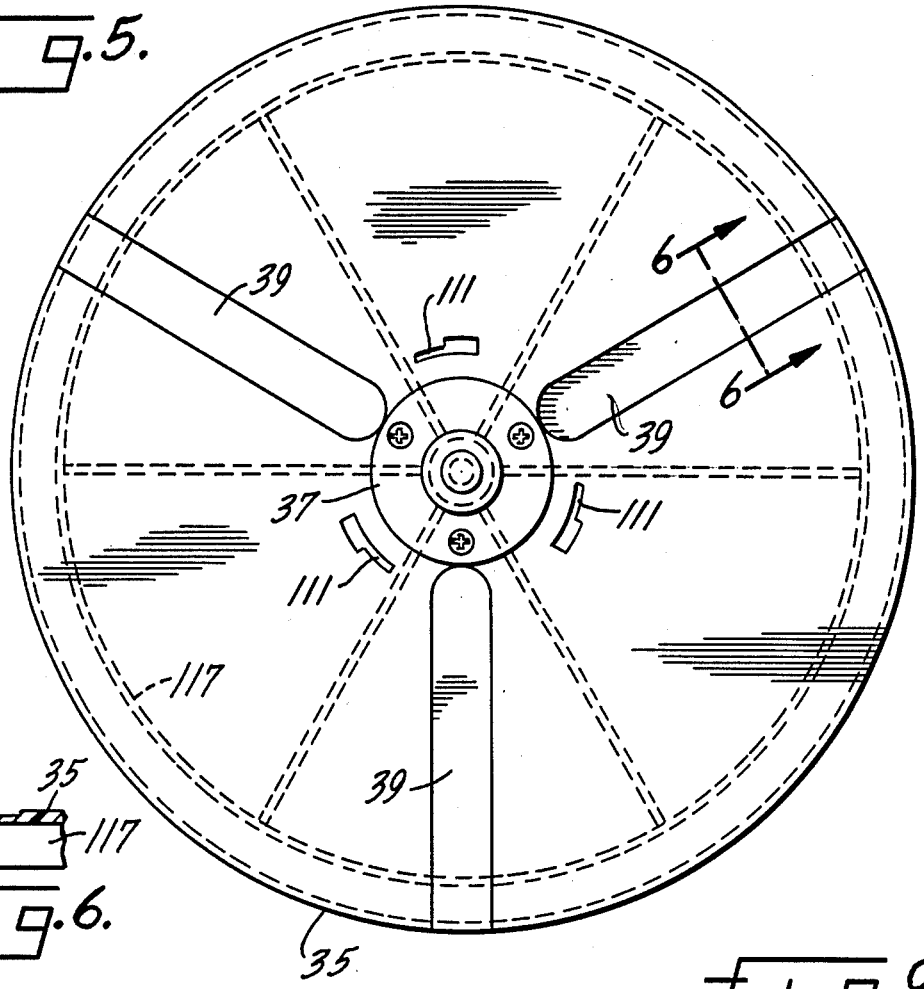
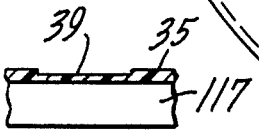
Fig. 6.
Fig. 9.
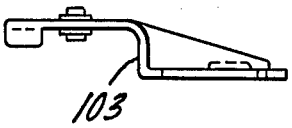
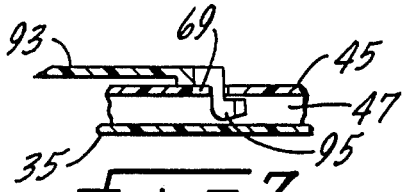
Fig. 7.
Fig. 10.
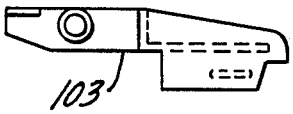
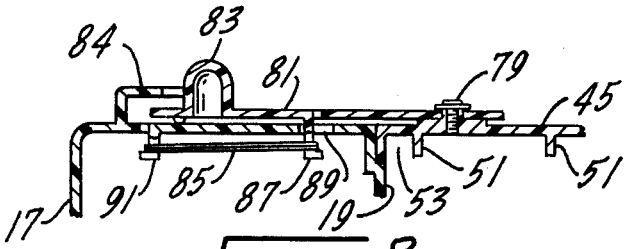
Fig. 8.

ANTEATER GAME

BACKGROUND AND SUMMARY OF THE INVENTION

This invention is directed to a tabletop action game which may be played by two, three or four players. It is a game that utilizes small parts, yet is safe for use by young children since the small parts are contained where they cannot be touched by the players while still being visible. Success in the game is dependent upon the dexterity and reflexes of the players and can be operated at different speeds to challenge different levels of skill.

The game provides the illusion that the small parts which resemble ants are actually crawling at high speeds around the platform, while in fact they are being moved by a disk rotating at relatively high speeds under a transparent plastic cover. Small depressions in the surface of the disk keep the plastic ants from slipping when the disk rotates and ensure that they will move rapidly. The walls on the under surface of the transparent plastic cover define pockets for capturing and holding the ants and establish flow paths around the periphery of the disk to direct the ants toward the pockets but away from directly entering the pockets. The arms which are movable by the players provide means for catching the ants as they flow past the entrances to the pockets. The exits from the pockets can be open to discharge the ants from the pockets when desired by the players.

The plastic parts which resemble ants that move on the rotating disk are made of what appears to be three small spherical portions of plastic joined together to form an elongated, somewhat cylindrical object that resembles the body of an ant. In actual practice, the ant body is molded as a single piece. The use of spherical portions to form the body rather than a solid cylinder provides an ant that does not have as much resistance to sliding and rolling friction as a cylinder would have. The ants are made of different colored plastics in equal numbers, with the colors of the groups of ants matching the colors of the pockets so each player will be able to quickly identify the ants he wishes to capture with his anteater arm. The arms enable the players to pick up ants of the desired color as the ants come around the barricades in the flow paths. By moving the arm after an ant is captured into alignment with the entrance to the pocket, the player can deposit the ant in his pocket. A normally closed but liftable gate is provided at the rear of the pocket to release the ants that have been captured if a player wishes to discharge the ants that have been captured.

Other purposes and objects of this invention will become apparent from a reading of the following specification, drawings and claims.

BRIEF DESCRIPTION OF THE DRAWINGS

The invention is illustrated more or less diagrammatically in the following drawings wherein:

FIG. 5 is a top plan view of the rotatable disk which moves the ants;

FIG. 6 is a cross-sectional view taken along line 6—6 of FIG. 5;

FIG. 7 is a partial, cross-sectional view of the finger portion of an ant arm taken along line 7—7 of FIG. 1;

FIG. 8 is a partial, cross-sectional view taken along line 8—8 of FIG. 1;

FIG. 9 is a top plan view of a pocket exit gate; and

FIG. 10 is a side elevational view of the gate of FIG. 9.

DESCRIPTION OF THE PREFERRED EMBODIMENT

Figure 1:
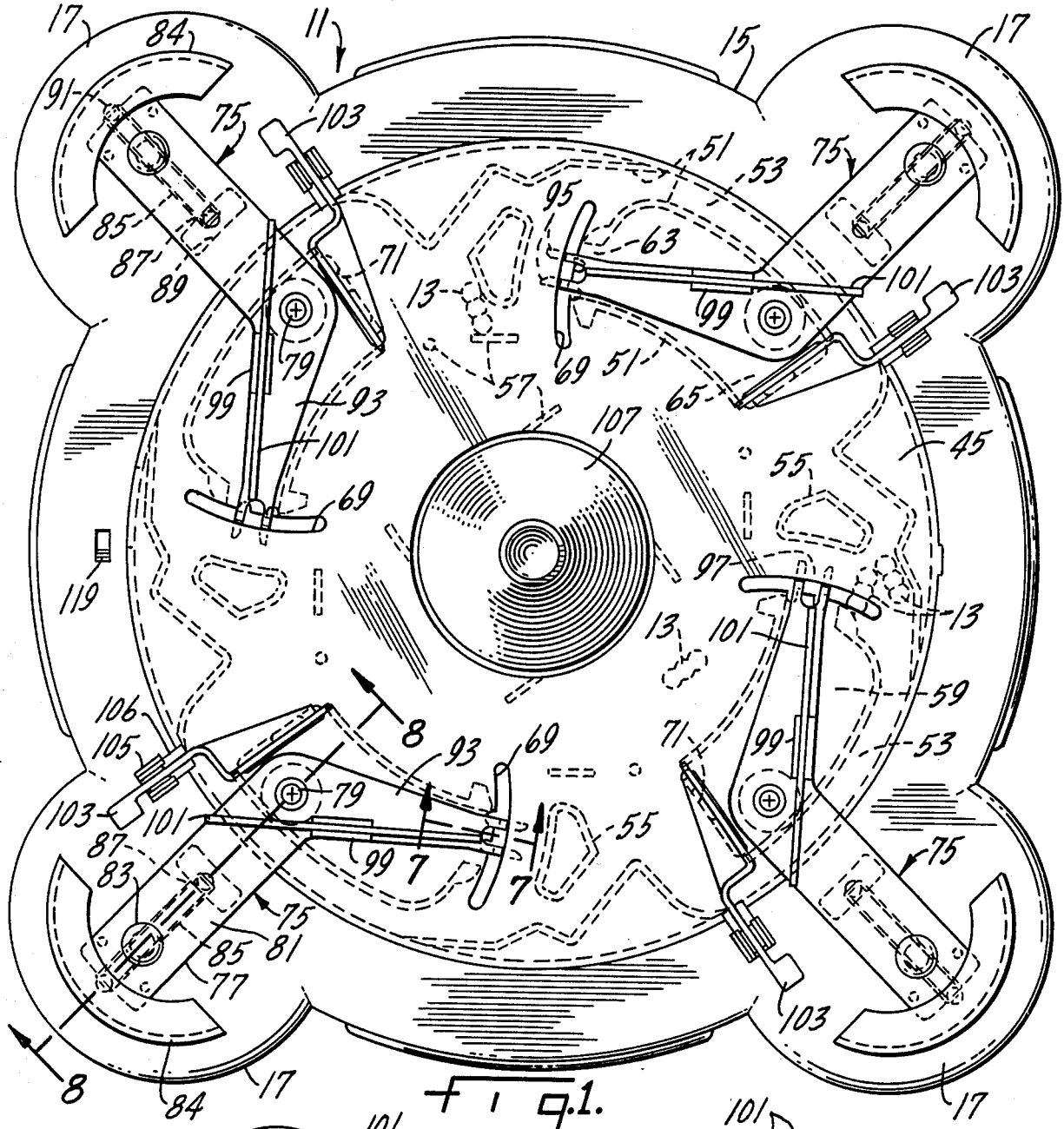
FIG. 1 is a top plan view of the game of this invention with some transparent parts shown in dashed lines, some hidden parts shown in dashed lines and only four of the ants used in the game shown in dashed lines, all for clarity of illustration.
Figure 2:
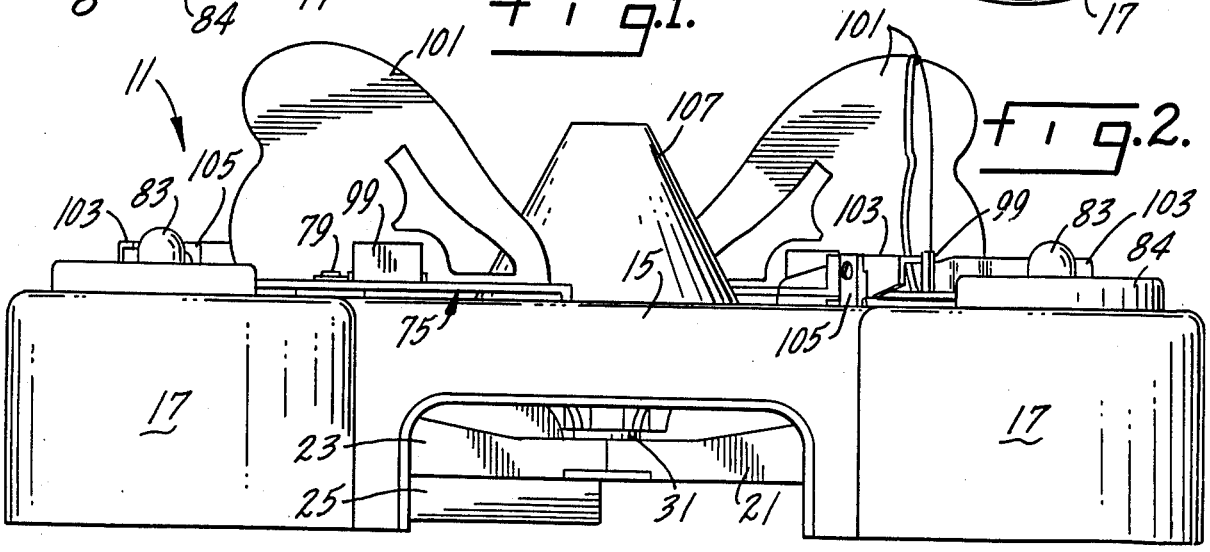
FIG. 2 is a side elevational view of the game of FIG. 1.

FIG. 1 of the drawings shows a table game 11 intended for use by two to four players, each of whom tries to capture certain of the small, plastic, somewhat cylindrical members 13, called "ants", which move around on the game board at high speed and resemble crawling ants. The ants 13 are each molded of a single piece of plastic having three somewhat spherical portions forming an elongated body resembling that of an ant. Normally, forty ants, ten of each of four distinctive colors, are provided, but for clarity of illustration of this invention only four ants are shown.

The game 11 includes an annular plastic, thin-walled housing 15 which may be conventionally molded from any suitable, durable plastic. Formed integrally with the exterior of the annular plastic housing are four semi-cylindrical protrusions 17, each located 90° apart around the circumference of the housing. A central opening 19 extends from the bottom to the top of the annular plastic housing.

Figure 3:
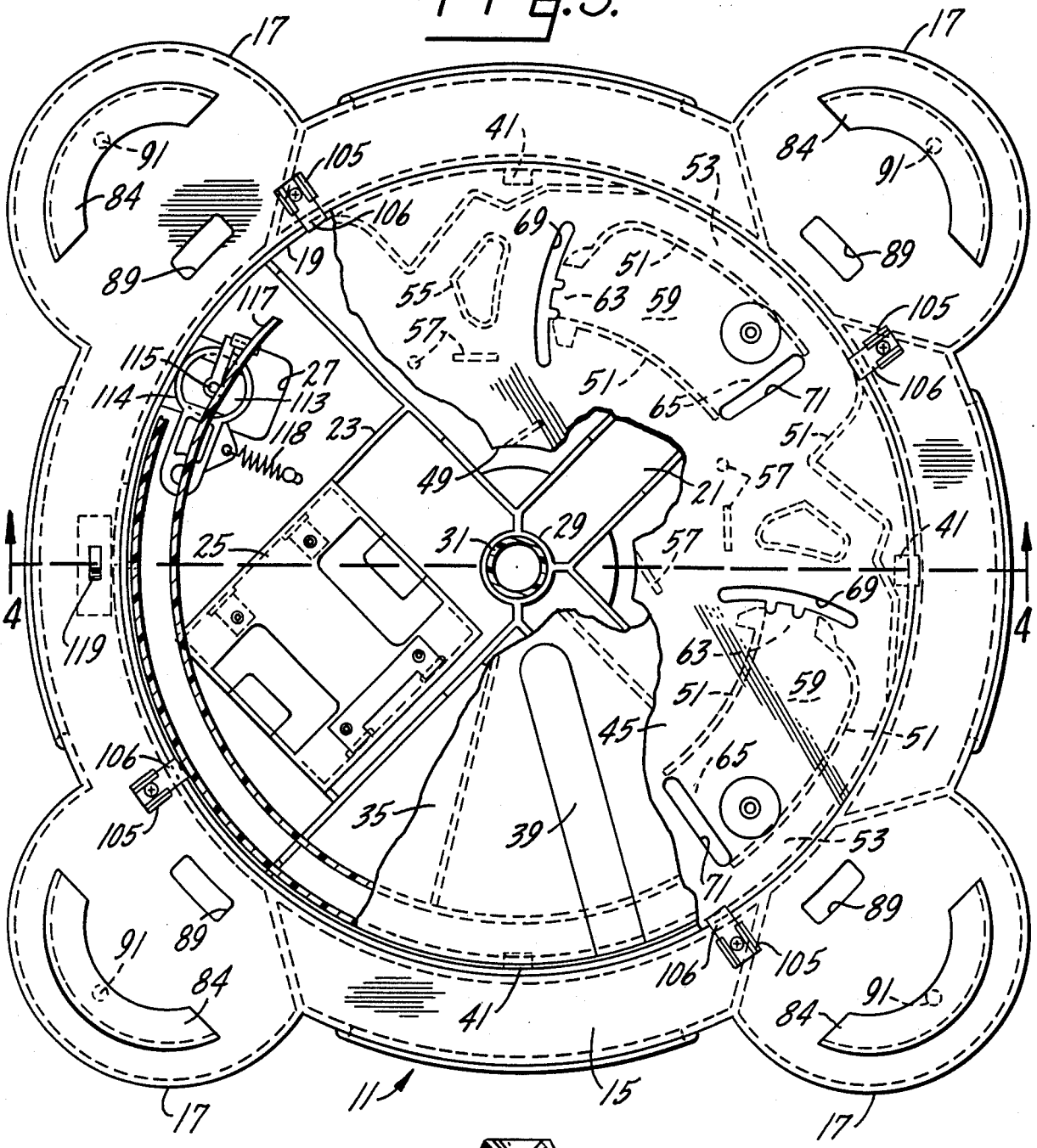
FIG. 3 is a top plan view of the game of FIG. 1 with some parts removed and others broken away for clarity of illustration.
Figure 4:
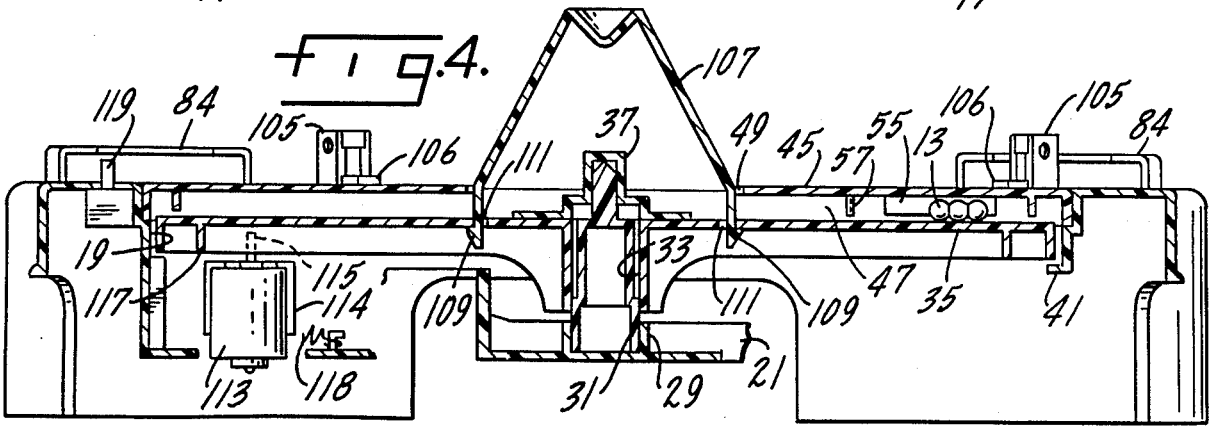
FIG. 4 is a cross-sectional view taken along line 4—4 of FIG. 3.

As can be best seen in FIGS. 3 and 4, a spoke-like framework 21 is located in the central opening 19 midway between the top and bottom of the housing. This framework has four spokes, each of which terminates at its outer end at a semi-cylindrical protrusion 17 of the housing 15. One quadrant 23 of the framework 21 is solid and a battery housing 25 and a drive motor opening 27 are formed in this quadrant. Also formed integrally with the spokes is a center support socket 29. A center pivot post 31 is seated in this socket in an upright position to extend through an opening 33 in a disk 35 to journal the disk for rotation on the center pivot post 31. A hub 37 is supported on the pivot post and is fastened to the disk 35 to journal the disk for rotation on the center pivot post 31. The disk 35 is sized to fit closely within the central opening 19 of the annular plastic housing 15.

Shallow, radially extending depressions 39 shown in FIGS. 3, 5 and 6 are formed in the top surface of the disk 35 to assist in keeping the plastic ants 13 moving around the disk as it rotates and to prevent bridging or piling up of the ants in one location. A plurality of horizontally extending tabs 41 (FIG. 4) extend from the central opening 19 of the annular plastic housing 15 and beneath the disk 35 around the perimeter thereof to provide support, if necessary, for the periphery of the disk.

A fixed, transparent cover 45 is mounted at the top of the central opening 19 of the annular plastic housing 15 to cover the rotatable disk 35 and is spaced a short distance above the disk to provide a raceway 47 (FIG. 4) between the disk and the transparent cover. The height of the raceway 47 is greater than the diameter of a plastic cylindrical ant 13 but less than the length of an ant in order to keep the ants lying on the surface of the rotating disk 35. The transparent cover 45 has a central opening 49 which receives the hub 37 of the disk 35. Formed integrally with and depending from the underside of the transparent cover 45 are a plurality of transparent plastic walls 51. The walls are shaped and positioned to form pathways 53, barriers 55, deflectors 57 and pockets 59 for the moving ants. The pockets 59 which are intended to hold captured ants 13 each have an entrance 63 facing the direction of rotation of the disk 35 and an outlet 65 facing a direction opposite to that of rotation of the disk.

The pathways 53 and barriers 55 are located to direct the moving ants 13 toward but not into the entrances 63 of the pockets 59. The raceways and barriers are located primarily around the outer perimeter of the transparent plastic cover 45, while the deflectors 57 are located around the central opening 49 of the cover to move the ants outwardly toward the pathways.

Arcuate slots 69 are formed in the transparent cover adjacent the entrances 63 of the pockets 59, while somewhat radially extending slots 71 are formed in the cover adjacent the outlet of each pocket.

A mechanism 75 for capturing the ants 13 and directing them into a pocket 59 is provided for each of the pockets. These mechanisms are shown in FIGS. 1, 2, 7 and 8. Each mechanism includes a horizontally, swingable, somewhat L-shaped lever 77 pivotally mounted at 79 to the transparent cover 45 directly over each pocket 59. Each lever includes an operating arm 81 which extends over one of the semi-cylindrical protrusions 17 of the plastic housing and has an upstanding knob 83 formed integrally therewith. The end of the operating arm 81 is covered by an arcuate shield 84 formed on top of a protrusion 17. Each operating arm is biased to a center position by a rubber band 85 connected to an integral post 87 on the arm extending downwardly through a slot 89 formed in the top of one of the cylindrical protrusions. The opposite end of the rubber band is connected to a post 91 formed on the underside of the housing. The rubber band biases the operating arm 81 to a center position relative to the pocket entrance 63.

Each ant-catching mechanism 75 also has an arm 93 that extends over the transparent cover and is equipped with depending fingers 95 at the distal end of the arm which define an ant catching opening 97. These fingers extend through one of the arcuate slots 69 formed in the tranparent cover into the raceway 47 where the fingers can be moved into engagement with the ants 13. The arm 93 is biased by its rubber band 85 to a central position where it normally blocks the entrance 63 of its pocket and is aligned with its barrier 55, which barrier effectively blocks ants from directly entering the ant-catching opening 97 formed between the depending fingers. Thus, the player must move his arm 93 into alignment with one of the pathways 53 on opposite sides of his pocket entrance barrier if he hopes to catch any one of the ants rotating with the disk 35. Once a player has caught an ant between the depending fingers, the arm can be rotated so that the fingers align with the entrance 63 of the pocket 59, and the movement of the disk will force the ant into the pocket 59.

An integrally-formed bracket 99 extends upwardly from each operating arm to receive and support a replica 101 of an anteater. Each of the four replicas of the anteaters are colored to match one of four colors of the ants 13 so that a player will know which ants to try to catch. A vertically swinging gate 103 is provided to close the outlet 65 of each pocket 59. The gate projects through the slot 71 into the raceway 47 and is biased by its weight to a normally closed position so that any ants 13 captured in a pocket will be held there until the player desires their release. To prevent unintentional lifting of the gate due to pressure exerted on the gate by the ants 13 captured in its pocket, a small protrusion 104 formed on the side of the gate engages the underside of the transparent cover 45 at the edge of the slot 71 through which the gate projects. Each gate is pivotally mounted between the uprights of a U-shaped bracket 105 which rests on the top surface of the housing 15 and is held thereto by a screw. The bracket includes a base 106 which projects over the transparent cover 45 to retain it in position. A truncated, cone-shaped cover 107 resembling an ant hill fits into the central opening 49 of the transparent cover 45 to close the opening and hold the ants inside the raceway 47. This cover has lugs 109 which fit into arcuate slots 111 formed in the disk 35 to hold the ant hill-like cover in place.

A small, battery-driven electric motor 113, which can be best seen in FIGS. 3 and 4, is supported in a drive motor bracket 114 and has a friction shaft 115 which engages an inner depending rib 117 of the disk 35 near the perimeter thereof to drive the disk. The friction drive shaft 115 is biased into contact with the rib 117 by a spring 118 which connects the bracket 114. An electric switch 119 is mounted on the top of the plastic housing 15. This switch has three positions: off, low speed and high speed. In the low speed position only one of the two batteries in the battery housing 25 drives the electric motor 113, while in the high speed position both batteries drive the motor, thereby causing the disk 35 to rotate at a higher speed.

The use, operation and function of the invention are as follows. The table game of this invention permits the use of small, plastic objects 13 that resemble ants to be moved at varying speeds around a rotating disk 35 where the various players try to entrap only their color ants. Because the rotating disk 35 is completely enclosed by the plastic housing 15 and the transparent cover 45, there is no danger of losing the small, plastic ants 13 or having a child accidentally swallow one. The transparent plastic cover enables the ants to be seen as they move around on the disk 35 without being available to be touched. This transparent cover also acts as a safety cover to prevent the rapidly rotating disk 35 from being touched by any of the players.

The shape of the ants 13 is important to their ability to move and roll in a random fashion similar to the movements of real ants. This is accomplished by forming a body having the appearance of three spheres of plastic joined together to form one elongated, cylindrical-like ant 13. The provision of a body comprised of spheres rather than a solid cylinder of plastic provides easier rolling for the ants with less friction, and, in addition, gives them an appearance of an ant body.

In a game, each player will try to capture its own color ants and not those of the opponents. The anteater replica 101 of his station will be the same color as the ants he is to capture. When all the ants of one color have disappeared from the board, the player with that color anteater wins, even if he has not captured all of his ants. Therefore, it is sometimes advantageous if one color of ants has just about been captured from the board for the other players holding such color ants of this color to open their gates 103 and discharge their ants to maintain some ants of all colors on the disk and thus continue the game.

I claim:

1. A game including an annular plastic housing having a central opening extending from the top to the bottom thereof, a rotatable disk located in the central opening, means to rotate the disk in at least one direction of rotation, a transparent cover mounted on the annular housing enclosing the top of the central opening, the transparent cover positioned on the annular plastic housing a small distance above the rotatable disk to provide a raceway between the disk and the cover, a plurality of walls depending from the transparent cover, with the walls terminating slightly above the rotatable disk, the walls shaped to form pockets and flow paths as well as barricades for the pockets around the periphery of the cover, a plurality of small, somewhat cylindrical plastic parts located on the disk to be moved through the raceway upon rotation of the disk, each pocket having an inlet opening facing the direction of rotation of the disk and an outlet opening facing away from the direction of rotation of the disk, means to open and close the outlet opening of each pocket, with said means normally being biased to an outlet closing position, an arm swingable in an arc across a portion of the top of the cover installed at each pocket, each arm having a guide portion normally biased to a position to block the entrance to its pocket, and each guide portion having a pair of fingers positioned to receive one of the small, plastic cylindrical parts lengthwise and admit to the pocket when the guide is located at the entrance to its pocket.

2. The game of claim 1 in which the pockets are each designated by a distinctive color, and an equal number of the plastic cylindrical parts are identified with the color of a pocket.

3. The game of claim 1 in which the guide portions of the arm are limited to swinging movement only in the outer peripheral flow paths, with the cylindrical plastic parts guided for movement on the rotating disk by the depending walls of the cover.

4. The game of claim 1 in which the depending walls of the transparent cover form flow barriers directly in front of the entrances to the pockets to reduce the possibility of parts entering the pocket when the guide portion is in its normal entrance blocking position of the pocket.

5. The game of claim 1 in which the small, cylindrical plastic parts consist of three small spherical portions forming an elongated part.

6. The game of claim 1 in which shallow, radially-extending depressions are formed on the upper surface of the disk to prevent slippage of the plastic parts as the disk rotates.

7. The game of claim 1 in which the means to rotate the rotatable disk includes an electric motor having a drive shaft which directly engages the rotatable disk near the periphery thereof.

8. The game of claim 7 in which means are provided to bias the electric motor drive shaft into engagement with the rotatable disk.

* * * * *